US005310283A

United States Patent [19]

Berg

[11] Patent Number: 5,310,283

[45] Date of Patent: May 10, 1994

[54] FLOATING BARRAGE

[75] Inventor: Leif Berg, Arhus C, Denmark

[73] Assignee: Berg Marine A/S, Arhus C, Denmark

[21] Appl. No.: 856,201

[22] PCT Filed: Nov. 16, 1990

[86] PCT No.: PCT/DK90/00296

§ 371 Date: May 13, 1992

§ 102(e) Date: May 13, 1992

[87] PCT Pub. No.: WO91/07546

PCT Pub. Date: May 30, 1991

[30] Foreign Application Priority Data

Nov. 17, 1989 [DK] Denmark ..... 5774/89

[51] Int. Cl.[5] ..... E02B 3/00

[52] U.S. Cl. ..... 405/67; 405/63

[58] Field of Search ..... 405/63, 66, 68, 72, 405/64, 69; 210/923, 924, 242.3

[56] References Cited

U.S. PATENT DOCUMENTS

| | | | |
|---|---|---|---|
| 3,792,589 | 2/1974 | Sayles | 405/68 |
| 3,849,989 | 11/1974 | Preus | 405/68 |
| 3,859,796 | 1/1975 | Benson | 405/68 X |
| 3,922,861 | 12/1975 | Grihangne . | |
| 4,201,495 | 5/1980 | Preus | 405/63 |
| 4,537,528 | 8/1985 | Simpson | 405/63 X |
| 4,573,426 | 3/1986 | Larsson | 405/68 |
| 5,074,709 | 12/1991 | Stensland | 405/63 X |

FOREIGN PATENT DOCUMENTS

| | | |
|---|---|---|
| 94595 | 8/1959 | Norway . |
| 317928 | 11/1969 | Sweden . |
| 340593 | 11/1971 | Sweden . |
| 348780 | 9/1972 | Sweden . |
| 436435 | 12/1984 | Sweden . |
| 953743 | 4/1964 | United Kingdom . |

*Primary Examiner*—Dennis L. Taylor

*Attorney, Agent, or Firm*—Watson, Cole, Grindle & Watson

[57] ABSTRACT

A floating barrage comprising an air-containing buoyancy member (13) and a curtain suspended from the buoyancy member (13) which curtain is maintained in approximately vertical position in the water by a ballast member (9) connected to the curtain, wherein the buoyancy member and the curtain are constituted by an envelope formed by a flexible film (4) having a lower edge (7) connected to the ballast member (9) and in which the envelope contains air in a significantly smaller amount than the amount required to inflate the envelope but sufficient to keep the envelope and the ballast floating in water with part of the envelope projecting above the water surface.

10 Claims, 5 Drawing Sheets

FLOATING BARRAGE

BACKGROUND OF THE INVENTION

1. Field of the Invention

The present invention relates to a floating barrage comprising an air-containing buoyancy portion and a curtain suspended from such portion, the curtain being maintained in an approximately vertical position in the water by a ballast member connected to the curtain, the buoyancy portion having the form of an air-tight envelope formed by a flexible film having a lower edge connected to the ballast member.

2. The Prior Art

It is known to confine pollutions of lakes and seas, especially oil pollutions, by launching floating barrages on the water surface with the object of containing or encircling the pollution, thereby preventing it from spreading, and facilitating decontamination.

Floating barrages are known in which the buoyancy member consists of a tube which is inflated before launching.

Such floating barrages suffer from the drawback that they are very voluminous, hence requiring much space during transport to the site of launching, and they are difficult to handle.

Floating barrages are also known in which the buoyancy member is formed by inflation of a tubular member in connection with the launching. Floating barrages of this type are described in, e.g., SE published patent application No. 436,435, NO patent specification No. 94,595 and DE patent publication No. 2,363,500. Such an inflation is laborious and time-consuming.

Furthermore, floating barrages have been developed which comprise mechanical members, such as springs, for automatic inflation of the buoyancy member after launching of the floating barrages on the water surface. Examples of this type of floating barrages are disclosed in DE patent specification No. 2,226,725, SE published patent application No. 340,593 and DK patent specification No. 139,308.

Moreover, SE published patent application No. 438,343 discloses a floating barrage which consists of an envelope having a water absorbing porous material located in its lower end, and which has a hole through which water can flow into the envelope. In launching the known floating barrage, the inflowing of water will be absorbed in the water-absorbing material, and the amount of air contained therein will be displaced to the upper portion of the envelope, thereby causing this portion to act as a buoyancy member. The known floating barrage is heavy to maneuver and difficult to remove and dispose of after use.

U.S. Pat. No. 3,922,861 describes a floating barrage which comprises a tubular air-tight buoyancy portion having air inlet means for blowing air into the tubular buoyancy portion in connection with the launching of the barrage on the water.

SE-B-348780 describes a floating barrage consisting of a plurality of air-filled buoyancy members which are attached to a curtain and a ballast member attached to one end of said curtain.

SUMMARY OF THE INVENTION

The object of the invention is to provide a floating barrage of a relatively small volume when packed, which does not require any inflation in connection with its launching on the water, and which is easy to handle.

The invention is based on the discovery that only a small amount of air is required to keep a film envelope with ballast floating with part of the envelope projecting from the water surface, and that this relatively small amount of air contained in an envelope having such size so as to act as buoyancy member as well as curtain after launching on the water surface, imparts to the envelope only a small increase in volume so that only a minimum of space is required for storage and transport of the floating barrage to the site of use.

The invention is further based on the discovery that after having been launched on the water, an air pocket will automatically be formed at the upper end of the envelope of such floating barrage, and that the portion located beneath will be folded up to form a curtain.

For instance the envelope may consist of two welded plastic films which are connected, e.g., along the edges. However, it preferably consists of a plastic film which is folded around its longitudinal axis, the folded sections of the film being interconnected, e.g., by welding along the free edges.

Preferably the envelope has the form of a long tube, which is compartmented into air-tight sections by means of welding seams. Preferably these welding seams extend perpendicularly to the longitudinal axis of the tube.

Thus, it is ensured that the function of the floating barrage will only be slightly affected in case of a puncture of same. The compartmentalization is preferably provided by means of double welding seams which are narrowly spaced to form pockets for stiffening members, e.g., stiffening plastic members, for buttressing the floating barrage in vertical direction.

The opposite sides of the tubular element may be interconnected in spots, e.g., by spot welding, spaced from the upper edge of the floating barrage to separate the area which is to from the buoyancy member after launching and the area which is to form the curtain. Thus, this separating zone is located close to the water line of the floating barrage.

To prevent rupture of the envelope during launching and/or maneuvering of the floating barrage, a rope or belt extending in the longitudinal direction of the floating barrage may be secured to the envelope. Such a rope or belt may, e.g., be disposed at the upper edge of the envelope or in the area mentioned above close to the water line of the floating barrage.

The ballast may consist of a metal chain, e.g., an iron chain or a sand-filled tube, and it is suitably located in a duct extending along the lower edge of the tubular member.

The envelope is preferably made from a plastic film, e.g., a polyolefin film, such as a polyethylene film having a thickness of 0.05–1 mm. As it may be practical to destroy the floating barrage after use by burning, a film material is preferably used which does not cause detrimental combustion or break-down products to be formed by thermal decomposition.

The floating barrage according to the invention can be manufactured in a very simple manner, e.g., in connection with extrusion of a plastic film or from a premanufactured plastic film. In either case the manufacturing is suitable carried out by folding the plastic film along its longitudinal axis and by making the necessary weldings in the longitudinal as well as the transverse direction.

The floating barrage according to the invention can, e.g., be stored and transported in a folded state in transport boxes of cardboard which are constructed so as to allow the floating barrage to be pulled out of the boxes by a ship or a helicopter after having been thrown out into the water from a ship or aeroplane/helicopter.

BRIEF DESCRIPTION OF THE DRAWINGS

The invention will now be explained in further detail with reference to the drawing in which.

Figure 1:
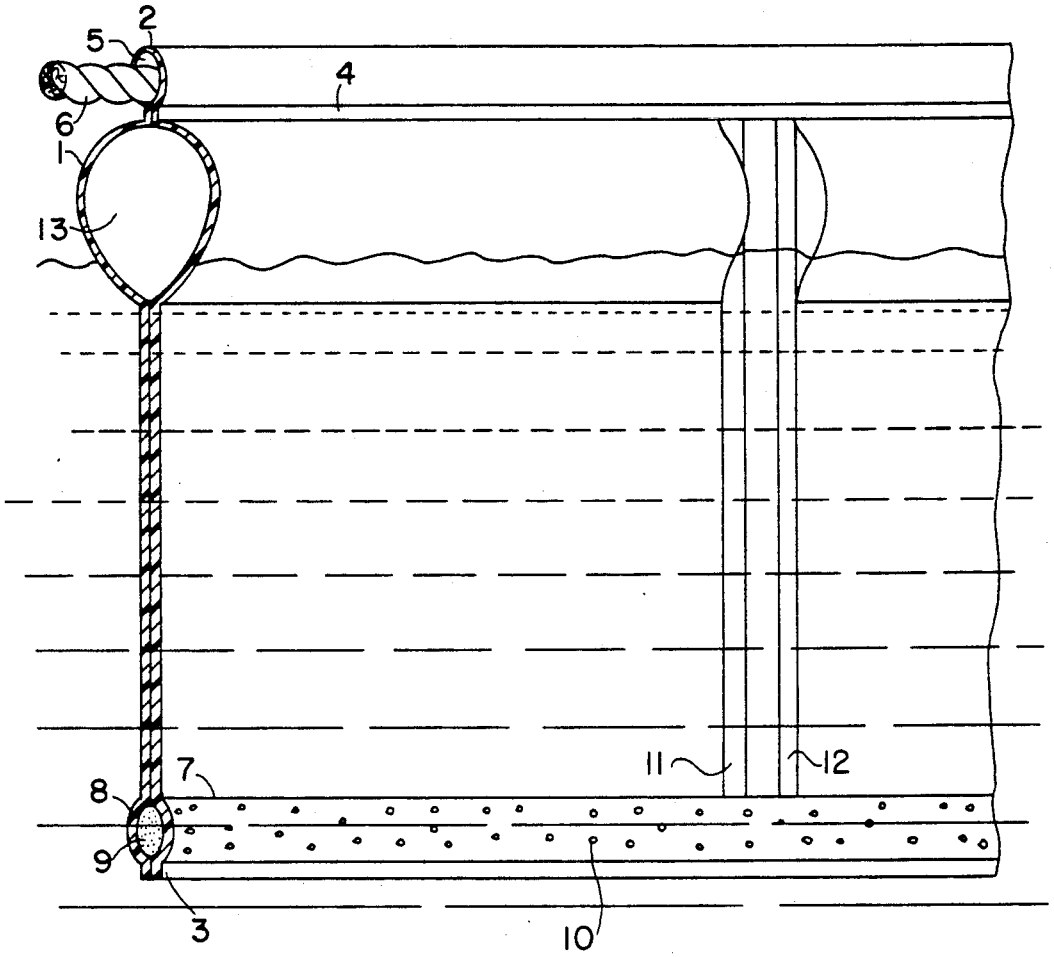
FIG. 1 is a perspective and partial sectional view of a preferred embodiment of a floating barrage according to the invention when floating on water.

The floating barrage shown in FIG. 1 is constructed of a plastic film which is folded along its longitudinal axis 2, the folded sections being interconnected at the longitudinal edges 3 of the film in the longitudinal direction. The plastic film sections are also interconnected in a zone 4 which is located a short distance from the longitudinal axis 2 to form a longitudinal duct 5 wherein a rope 6 is disposed. The film sections are also interconnected in the longitudinal direction in a zone 7 which is located a short distance from the longitudinal edges 3 to form a further longitudinal duct 8 wherein a ballast is disposed in the form of a sand filling 9. The walls of the longitudinal duct 8 are provided with holes 10 through which water can flow.

The folded film sections are further interconnected in two parallel zones 11 and 12 which extend perpendicularly to the longitudinal axis 3 of the film.

The folded film sections are not interconnected in the area between the zones 4 and 7, and when the floating barrage is placed in water the amount of air present in this zone will be concentrated in an air pocket 13 which forms the buoyancy member of the floating barrage and keeps it floating in the water with part of the air pocket and the duct 5 with the rope 6 located above the water surface. When the amount of air is uniformly distributed over the entire area between the zones 4 and 7, it will be possible to place the film sections close to each other, thus allowing long lengths of floating barrage to be placed in boxes of a relatively small volume.

Figure 2:
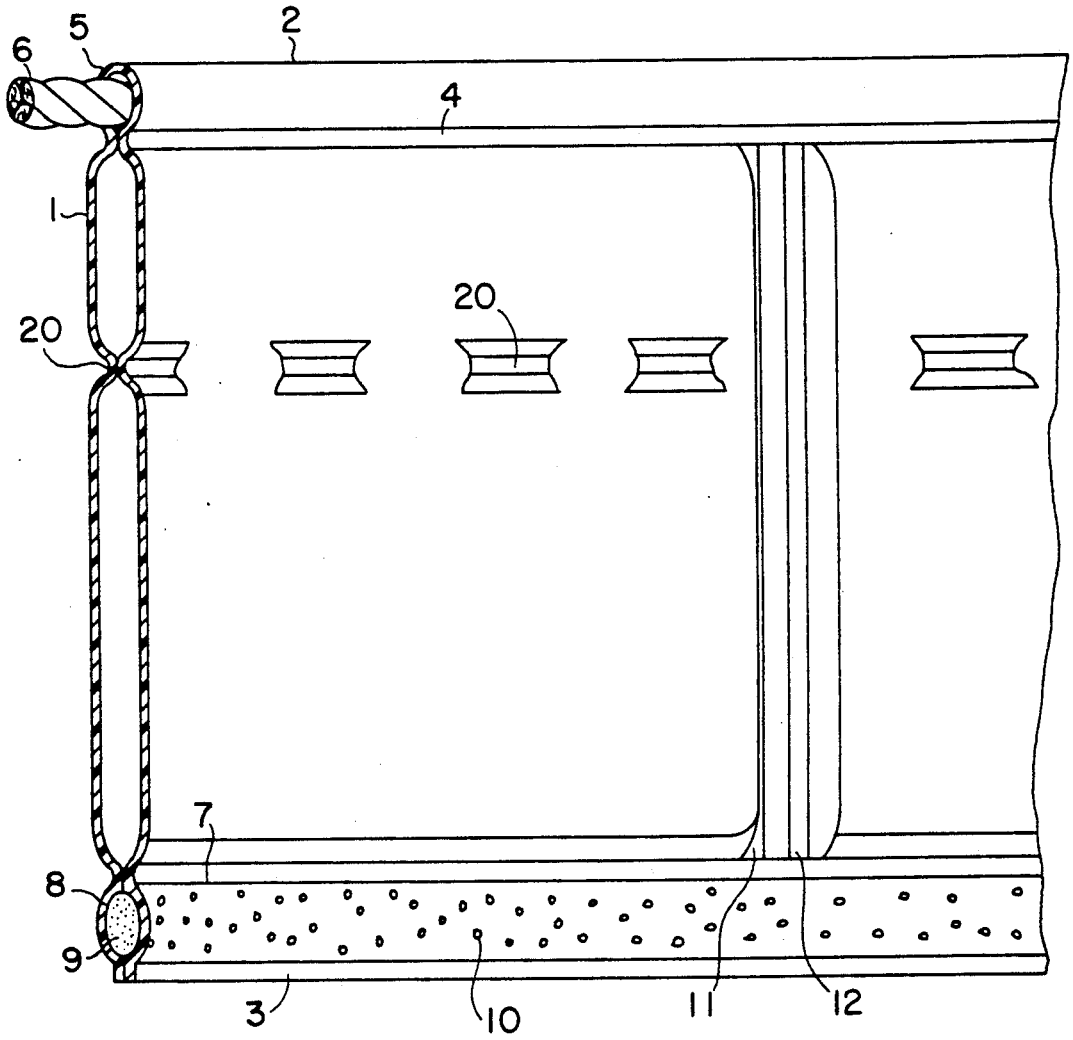
FIG. 2 is a perspective and partial sectional view of another embodiment of a floating barrage according to the invention prior to launching.

The floating barrage shown in FIG. 2 corresponds to the one shown in FIG. 1, and the same reference numbers have been used for designating the parts corresponding to the parts mentioned in connection with FIG. 1.

The floating barrage of FIG. 2 differs from the one shown in FIG. 1 in that the two film sections are interconnected in zones 20 which are mutually separated in the longitudinal direction.

FIG. 2 shows the floating barrage in a stored state before launching and having the air uniformly distributed between the two film sections.

Figure 3:
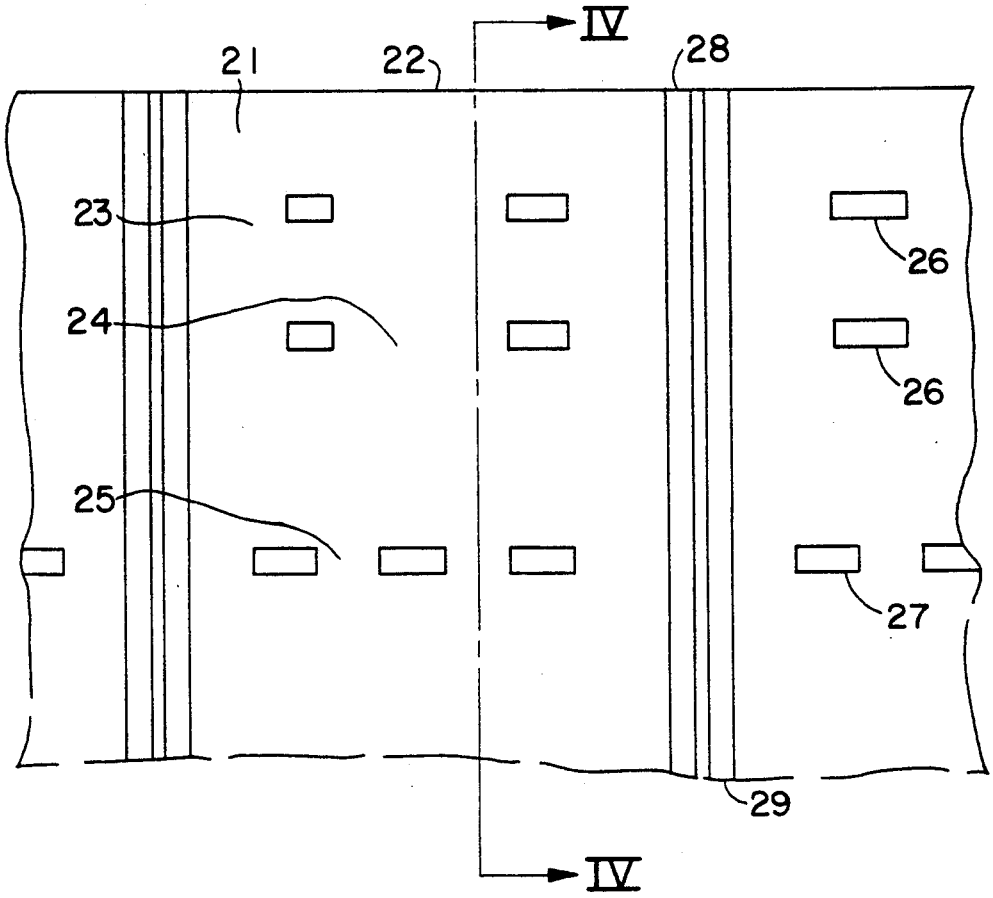
FIG. 3 is a side view of the upper portion of a further embodiment of a floating barrage according to the invention.
Figure 5:
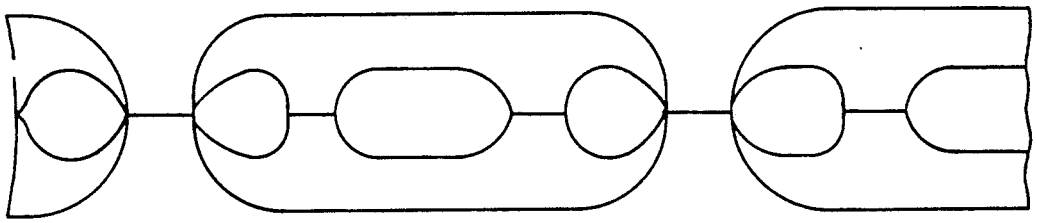
FIG. 5 is a view from above of the floating barrage of FIG. 3 after launching.
Figure 4:
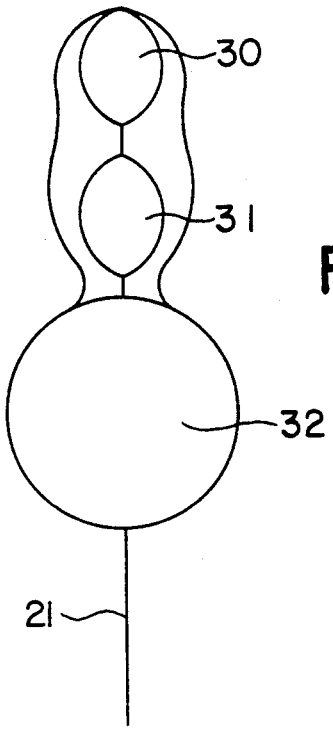
FIG. 4 is a sectional view along the line IV—IV of the floating barrage of FIG. 3 after launching.

The embodiment shown in FIGS. 3–5 also comprises a film 21 which is folded along its longitudinal axis, the two film sections being interconnected in the longitudinal direction in three zones 23, 24 and 25 which extend parallel to the longitudinal axis 22. In the first two zones 23 and 24 the films are interconnected in areas 26 which are relatively widely spaced, and in the third zone 25 the distance between the corresponding areas 27 is shorter.

The film sections are furthermore interconnected transversely to the longitudinal axis 22 in zones 28 and 29.

After launching, air pockets 30, 31 and 32 will be formed in the described floating barrage, the air pocket 32 having a greater vertical extension than the two other pockets due to the wider spacing between the zones 24 and 25 than the spacing between the zone 23 and the longitudinal axis 22. As a result of the difference in the spacings between the areas 26 and the areas 27, the horizontal extension of the air pockets is also different as it will appear from FIG. 5.

Figure 7:
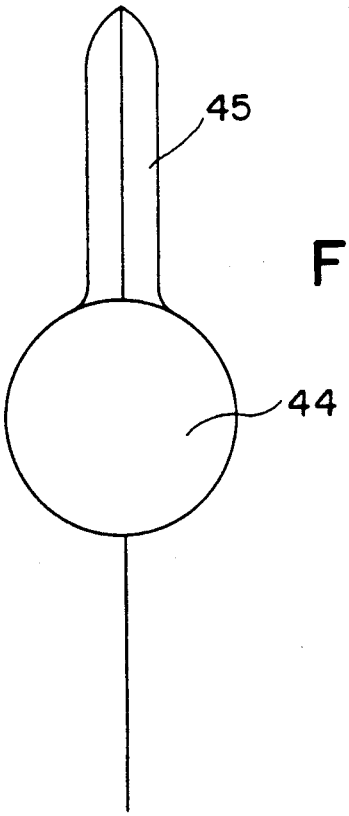
FIG. 7 is a sectional view along the line VII—VII of the floating barrage of FIG. 6 after launching and FIG. 8 is a view from above of the floating barrage of FIG. 6 after launching.
Figure 6:
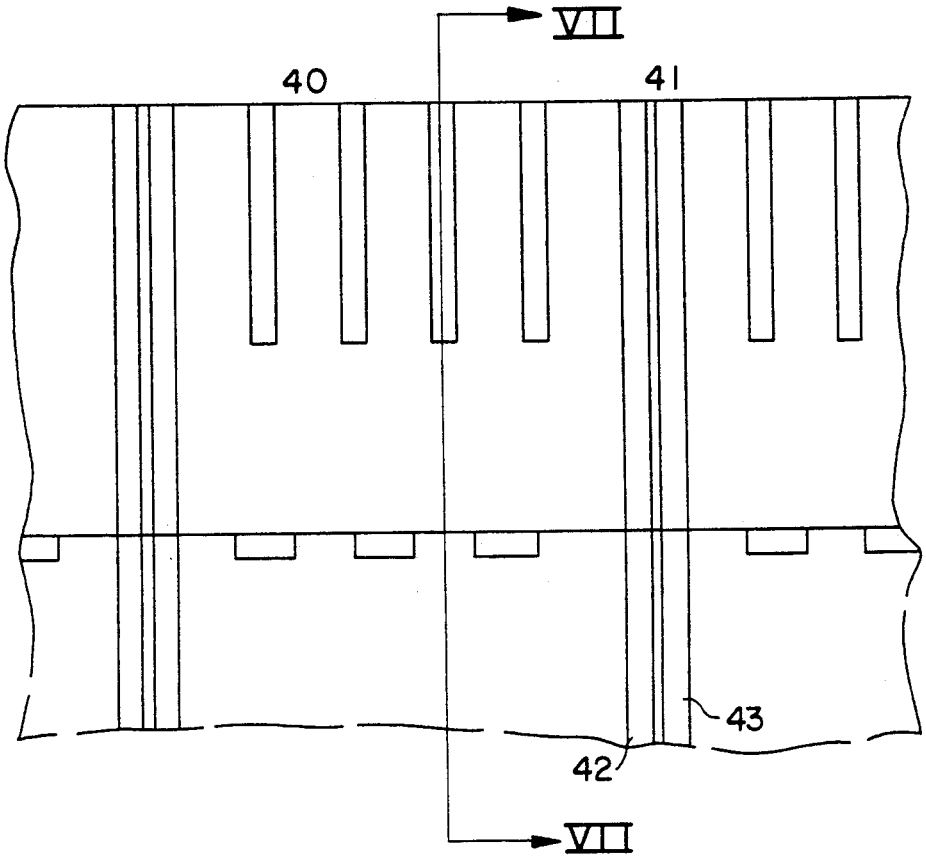
FIG. 6 is a side view of the upper part of yet another embodiment of the floating barrage according to the invention.
Figure 8:
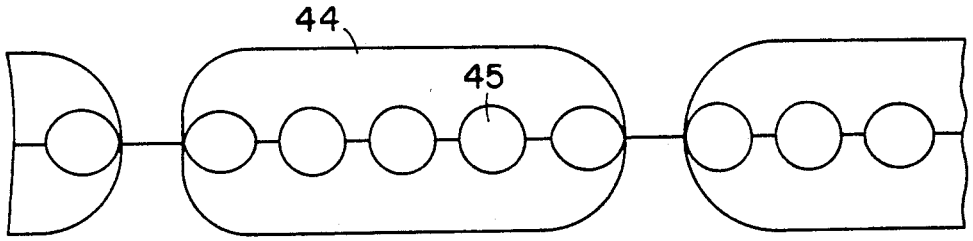

In the embodiment shown in FIGS. 6–8 the folded film sections are interconnected in relatively short zones 40 extending perpendicularly to the longitudinal axis 41 of the film and in zones 42, 43 which are parallel to the former zones but extend over the entire width of the floating barrage.

After launching, such floating barrage will form a number of relatively large air pockets 44 extending in the longitudinal direction of the floating barrage and at the top forming vertical air pockets 45 having approximately circular cross section, see FIG. 8.

The main object of interconnecting the foil sections in this area which after launching is located above the air pocket which provides the sufficient buoyancy, is to reduce the amount of air in the envelope and thereby reduce the volume of the floating barrage in a stored state.

I claim:

1. A floating barrage comprising an air-containing buoyancy portion and a curtain suspended from said portion, said curtain being maintained in an approximately vertical position in the water by a ballast member connected to the curtain, the buoyancy portion having the form of an air-tight envelope formed by a flexible film (1) having a lower edge connected to the ballast member, wherein the air-tight envelope, which is formed by the flexible film (1), constitutes both the buoyancy portion and the curtain, wherein the amount of air within the envelope is fixed and wherein no means are provided for introducing or evacuating air to or from the envelope.

2. A floating barrage according to claim 1, wherein the envelope consists of a plastic film which is folded along a longitudinal axis, the folded sections of the film being interconnected along free edges.

3. A floating barrage according to claim 2, wherein the envelope has the form of a tube which is compartmented into air-tight sections by means of welding seams.

4. A floating barrage according to claim 3, wherein the welding seams extend substantially perpendicularly to the longitudinal direction of the tube.

5. A floating barrage according to claim 4, including pockets containing stiffening members for buttressing the floating barrage in vertical direction.

6. A floating barrage according to claim 1, wherein opposite sides of the envelope are interconnected in spots spaced from an upper edge of the envelope.

7. A floating barrage according to claim 1, wherein a rope or belt extending in the longitudinal direction of the floating barrage is secured to the envelope.

8. A floating barrage according to claim 1, wherein the ballast member is located in a perforated duct extending along the lower edge of the envelope.

9. A floating barrage according to claim 8, wherein the ballast member consists of a metal chain or a sand-filled tube.

10. A floating barrage according to claim 1, wherein the envelope consists of a polyolefin film.

* * * * *